US007847529B2

(12) United States Patent
Kim

(10) Patent No.: US 7,847,529 B2
(45) **Date of Patent: *Dec. 7, 2010**

(54) DUAL LOOP LINEAR VOLTAGE REGULATOR WITH HIGH FREQUENCY NOISE REDUCTION

(75) Inventor: Seongwon Kim, Old Tappan, NJ (US)

(73) Assignee: International Business Machines Corporation, Armonk, NY (US)

( * ) Notice: Subject to any disclaimer, the term of this patent is extended or adjusted under 35 U.S.C. 154(b) by 596 days.

This patent is subject to a terminal disclaimer.

(21) Appl. No.: 11/847,416

(22) Filed: Aug. 30, 2007

(65) Prior Publication Data

US 2009/0059627 A1 Mar. 5, 2009

(51) Int. Cl.
*G05F 1/59* (2006.01)

(52) U.S. Cl. ..... 323/269; 323/268; 323/280

(58) Field of Classification Search ..... 323/268, 323/269, 271, 272, 273–281, 226
See application file for complete search history.

(56) References Cited

U.S. PATENT DOCUMENTS 4,283,690 A * 8/1981 Tarbouriech ..... 331/111
4,881,023 A 11/1989 Perusse et al.
6,710,583 B2 * 3/2004 Stanescu et al. ..... 323/280
6,909,264 B2 * 6/2005 Del Gatto et al. ..... 323/268
7,227,343 B2 6/2007 Jiang et al.
7,486,060 B1 * 2/2009 Bennett ..... 323/282

OTHER PUBLICATIONS

Co-pending U.S. Appl. No. 11/847,461, filed Aug. 30, 2007, entitled Method for Regulating a Voltage Using a Linear Voltage Regulator.

* cited by examiner

*Primary Examiner*—Harry Behm
(74) *Attorney, Agent, or Firm*—Cantor Colburn LLP

(57) ABSTRACT

A linear voltage regulator is provided. The linear voltage regulator includes a first circuit configured to receive the first voltage from a voltage source and to remove frequency components of the first voltage in a first frequency range to obtain an output voltage at a primary output node. The linear voltage regulator further includes a second circuit having first and second inverters electrically coupled to the primary output node of the first circuit. The second circuit is configured to receive the output voltage and to remove frequency components of the output voltage in a second frequency range. The second frequency range is greater than the first frequency range.

5 Claims, 6 Drawing Sheets

DUAL LOOP LINEAR VOLTAGE REGULATOR WITH HIGH FREQUENCY NOISE REDUCTION

CROSS-REFERENCE TO RELATED APPLICATION

This application is co-pending with U.S. patent application Ser. No. 11/847,461, the contents of which are incorporated herein by reference in their entirety.

FIELD OF INVENTION

This application relates to a linear voltage regulator.

BACKGROUND OF INVENTION

Voltage regulators have been utilized to control voltages applied to devices. A problem with the voltage regulators is that the voltage regulators have not been able to effectively remove both high frequency noise and low frequency noise from a voltage source. Further, the voltage regulators utilize at least two relatively expensive comparator chips which utilize a relatively large amount of power.

Accordingly, the inventor herein has recognized a need for an improved voltage regulator that minimizes and/or eliminates the above-mentioned problems.

SUMMARY OF INVENTION

A linear voltage regulator in accordance with an exemplary embodiment is provided. The linear voltage regulator includes a first circuit configured to receive the first voltage from a voltage source and to remove frequency components of the first voltage in a first frequency range to obtain an output voltage at a primary output node. The linear voltage regulator further includes a second circuit having first and second inverters electrically coupled to the primary output node of the first circuit. The second circuit is configured to receive the output voltage and to remove frequency components of the output voltage in a second frequency range. The second frequency range is greater than the first frequency range.

A linear voltage regulator in accordance with another exemplary embodiment is provided. The linear voltage regulator includes a first inverter having a first input terminal and a first output terminal. The first input terminal is electrically coupled to the first output terminal. The first input terminal is further electrically coupled to a capacitor which is further coupled to electrical ground. The first inverter is further electrically coupled to a primary output node such a first voltage on the first output terminal is less than the output voltage at the primary output node. The linear voltage regulator further includes a second inverter having a second input terminal and a second output terminal. The second input terminal is electrically coupled to the first output terminal of the first inverter. The second inverter is further electrically coupled to the primary output node and receiving the first voltage from the first inverter. The linear voltage regulator further includes a p-channel field effect transistor (P-FET transistor) having a gate terminal, a drain terminal and a source terminal. The source terminal is electrically coupled to a voltage source. The drain terminal is coupled to the primary output node. The gate terminal electrically communicates either directly or indirectly with the second output terminal of the second inverter, such that when the output voltage at the primary output node is increased, the first voltage on the first output terminal of the first inverter is less than the output voltage on the primary output node which induces the second inverter to output a high logic voltage on the second output terminal. The P-FET transistor reduces the output voltage on the primary output node in response to the high logic voltage.

DESCRIPTION OF EMBODIMENTS

Figure 1:
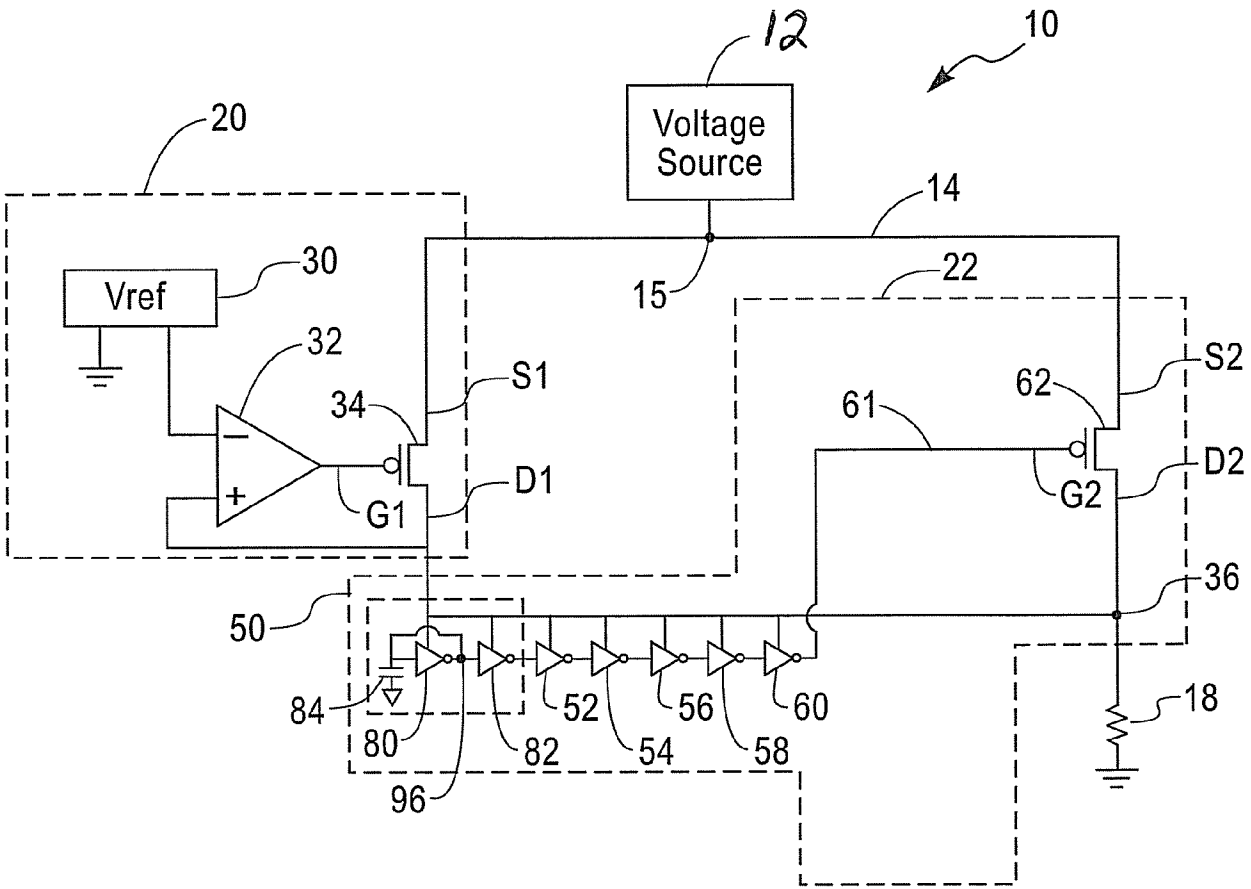
FIG. 1 is an electrical schematic of an electrical system having a linear voltage regulator in accordance with an exemplary embodiment.

Referring to FIG. 1, an electrical system 10 having a linear voltage regulator 14 in accordance with an exemplary embodiment is illustrated. The electrical system further includes a voltage source 12 and a load 18. An advantage of the linear voltage regulator 14 is that the regulator is able to output a voltage that has minimal voltage deviation for voltage-sensitive load devices.

The voltage source 12 is provided to output a voltage that may deviate from a desired voltage level. The voltage source 12 is electrically coupled to the linear voltage regulator 14.

The linear voltage regulator 14 is provided to receive the voltage from the voltage source 12 and to output a voltage that has a minimal voltage deviation from a desired voltage level. The linear voltage regulator 14 includes a circuit 20 and a circuit 22.

The circuit 20 is provided to remove frequency components of the voltage received from voltage source 12 in a first frequency range to obtain an output voltage at the primary voltage node 36 with reduced voltage deviation. In one exemplary embodiment, the circuit 20 is configured to remove frequency components of the voltage received from the voltage source 12 in the frequency range of 0 to 10 Megahertz. Of course, in alternative embodiments of circuit 20, the circuit 20 can remove frequency components in other frequency ranges. The circuit 20 includes a voltage reference device 30, an operational amplifier 32, and a P-FET transistor 34. The operational amplifier 32 has an inverting input terminal "−", a non-inverting input terminal "+", and an output terminal. The P-FET transistor has a gate terminal (G1), a source terminal (S1), and a drain terminal (D1). The voltage reference device 30 is electrically coupled to the inverting input terminal "−" of the operational amplifier 32. The voltage reference device 30 is configured to output a desired reference voltage level. The output terminal of the operational amplifier 32 is electrically coupled to the gate terminal (G1) of the P-FET transistor 34. The non-inverting terminal "+" of the operational amplifier 32 is electrically coupled to the drain terminal (D1) of the P-FET transistor 34 and further coupled to the primary output node 36.

During operation of the circuit 20, when the output voltage of the voltage source 12 decreases, the voltage received by the non-inverting terminal "+" of the operational amplifier 32 has a low logic voltage relative to a high logic voltage on the inverting terminal "−", which induces the operational amplifier 32 to output a low logic voltage. In response to the low logic voltage on the gate terminal (G1) of the P-FET transistor 34, the P-FET transistor 34 increases current flowing from the source terminal (S1) to the drain terminal (D1) which causes the output voltage on the primary output node 36 to increase. Alternately, when the output voltage of the voltage source 12 increases, the voltage received by the non-inverting terminal "+" of the operational amplifier 32 has a high logic voltage relative to a low logic voltage on the inverting terminal "−", which induces the operational amplifier 32 to output a high logic voltage. In response to the high logic voltage on the gate terminal (G1) of the P-FET transistor 34, the P-FET transistor 34 decreases current flowing from the source terminal (S1) to the drain terminal (D1) which causes the output voltage on the primary output node 36 to decrease.

The circuit 22 is provided to remove frequency components of the voltage received from voltage source 12 in a second frequency range to obtain an output voltage at the primary voltage node 36 with reduced voltage deviation. In one exemplary embodiment, the circuit 22 is configured to remove frequency components of the voltage received from the voltage source 12 in the frequency range of 10 Megahertz to 6 Gigahertz. Of course, in alternative embodiments of circuit 22, the circuit 22 can remove frequency components in other frequency ranges. The circuit 22 includes a comparator circuit 50, inverters 52, 54, 56, 58, 60, and a P-FET transistor 62.

Figure 2:
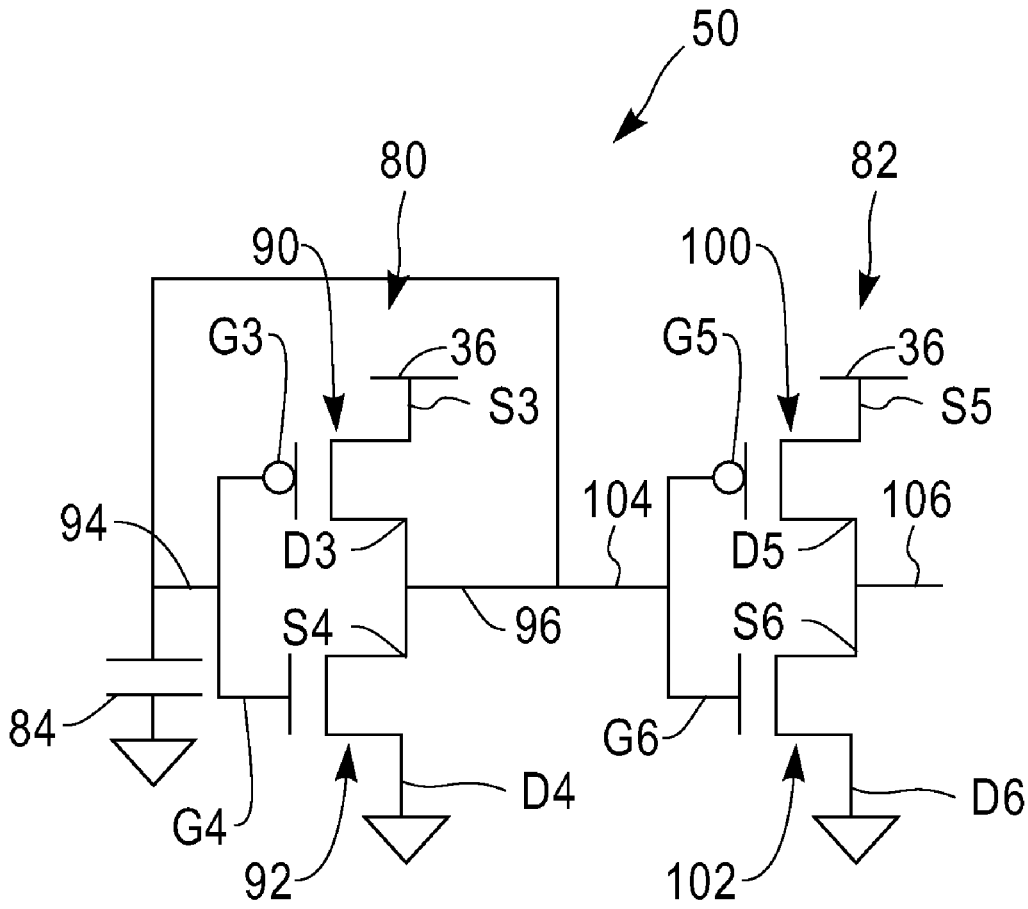
FIG. 2 is an electrical schematic of a comparator circuit utilized in the linear voltage regulator of FIG. 1.

Referring to FIGS. 1 and 2, the comparator circuit 50 is provided to detect a voltage deviation on the primary output node 36. The comparator circuit 50 includes inverters 80, 82 and a capacitor 84.

The inverter 80 includes a P-FET transistor 90, a FET transistor 92, an input terminal 94, and an output terminal 96. The P-FET transistor 90 includes a gate terminal (G3), a source terminal (S3), and a drain terminal (D3). The FET transistor 92 includes a gate terminal (G4), a source terminal (S4), and a drain terminal (D4). The P-FET transistor 90 is electrically coupled to the FET transistor 92. In particular, the gate terminals (G3), (G4) are electrically coupled together at the input terminal 94. The source terminal (S3) is electrically coupled to the primary output node 36. The drain terminal (D3) is electrically coupled to the source terminal (S4) at the output terminal 96. The output terminal 96 is electrically coupled to the input terminal 94. The terminal (D4) is electrically coupled to electrical ground. The capacitor 84 is electrically coupled between the input terminal 94 and electrical ground. During operation, a voltage on the output terminal 96 is less than the output voltage at the primary output node 36. In particular, a voltage on the output terminal 96 is approximately one-half of the voltage at the primary output node 36.

The inverter 82 includes a P-FET transistor 100, a FET transistor 102, an input terminal 104, and an output terminal 106. The P-FET transistor 100 includes a gate terminal (G5), a source terminal (S5), and a drain terminal (D5). The FET transistor 102 includes a gate terminal (G6), a source terminal (S6), and a drain terminal (D6). The P-FET transistor 100 is electrically coupled to the FET transistor 102. In particular, the gate terminals (G5), (G6) are electrically coupled together at the input terminal 104. The input terminal 104 is electrically coupled to the output terminal 96. The source terminal (S5) is electrically coupled to the primary output node 36. The drain terminal (D5) is electrically coupled to the source terminal (S6) at the output terminal 106. The output terminal 106 is electrically coupled to an input terminal 114. The terminal (D6) is electrically coupled to electrical ground.

During operation of the comparator circuit 50, when an output voltage at the primary output node 36 is increased, the voltage on the output terminal 96 of the inverter 80 is less than the output voltage on the primary output node 36 which induces the inverter 82 to output a high logic voltage on the output terminal 106. The high logic voltage is utilized to subsequently induce the P-FET transistor 62 to reduce the output voltage on the primary output node 36 in response to the high logic voltage. Alternately, when the output voltage at the primary output node 36 is decreased, the voltage on the output terminal 96 of the inverter 80 is greater than the output voltage on the primary output node 36 which induces the inverter 82 to output a low logic voltage on the output terminal 106. The low logic voltage is subsequently utilized to induce the P-FET transistor 62 to increase the output voltage on the primary output node 36 in response to the low logic voltage.

Figure 3:
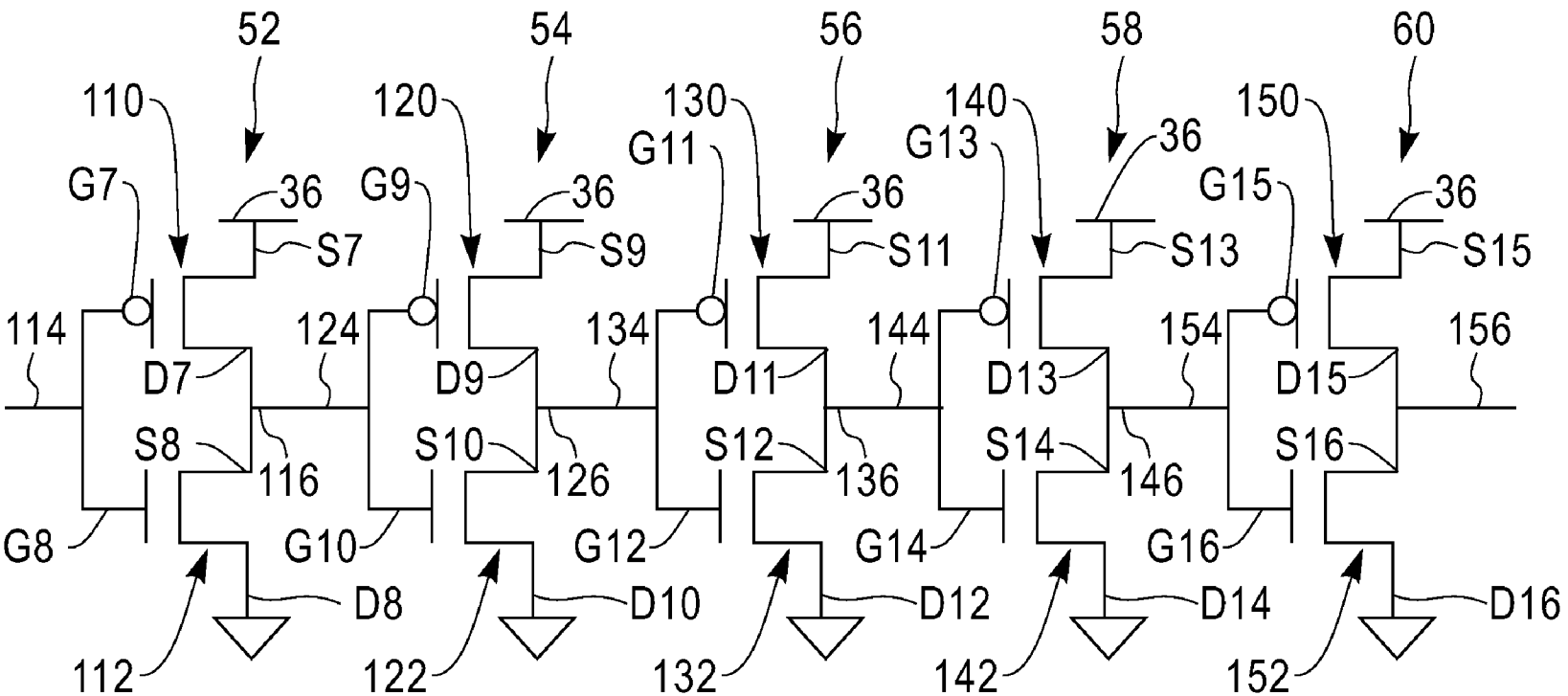
FIG. 3 is an electrical schematic of a plurality of inverters utilized in the linear voltage regulator of FIG. 1.

Referring to FIGS. 1 and 3, the chain of inverters 52, 54, 56, 58, 60 are provided to amplify the output voltage from the comparator circuit 50 which is received by the gate terminal (G2) of the P-FET transistor 62.

The inverter 52 includes a P-FET transistor 110, a FET transistor 112, an input terminal 114, and an output terminal 116. The P-FET transistor 110 includes a gate terminal (G7), a source terminal (S7), and a drain terminal (D7). The FET transistor 112 includes a gate terminal (G8), a source terminal (S8), and a drain terminal (D8). The P-FET transistor 110 is electrically coupled to the FET transistor 112. In particular, the gate terminals (G7), (G8) are electrically coupled together at the input terminal 114. The source terminal (S7) is electrically coupled to the primary output node 36. The drain terminal (D7) is electrically coupled to the source terminal (S8) at the output terminal 116. The output terminal 116 is electrically coupled to an input terminal 124. The terminal (D8) is electrically coupled to electrical ground. During operation, the inverter 52 receives an output voltage at the input terminal 114 from the comparator circuit 50 and outputs an inverted amplified output voltage at the output terminal 116.

The inverter 54 includes a P-FET transistor 120, a FET transistor 122, an input terminal 124, and an output terminal 126. The P-FET transistor 120 includes a gate terminal (G9), a source terminal (S9), and a drain terminal (D9). The FET transistor 122 includes a gate terminal (G10), a source terminal (S10), and a drain terminal (D10). The P-FET transistor 120 is electrically coupled to the FET transistor 122. In particular, the gate terminals (G9), (G10) are electrically coupled together at the input terminal 124. The source terminal (S9) is electrically coupled to the primary output node 36. The drain terminal (D9) is electrically coupled to the source terminal (S10) at the output terminal 126. The output terminal 126 is electrically coupled to an input terminal 134. The terminal (D10) is electrically coupled to electrical ground. During operation, the inverter 54 receives an output voltage at the input terminal 124 from the inverter 52 and outputs an inverted amplified output voltage at the output terminal 126.

The inverter 56 includes a P-FET transistor 130, a FET transistor 132, an input terminal 134, and an output terminal 136. The P-FET transistor 130 includes a gate terminal (G11), a source terminal (S11), and a drain terminal (D11). The FET transistor 132 includes a gate terminal (G12), a source terminal (S12), and a drain terminal (D12). The P-FET transistor 130 is electrically coupled to the FET transistor 132. In particular, the gate terminals (G11), (G12) are electrically coupled together at the input terminal 134. The source terminal (S11) is electrically coupled to the primary output node 36. The drain terminal (D11) is electrically coupled to the source terminal (S12) at the output terminal 136. The output terminal 136 is electrically coupled to an input terminal 144. The terminal (D12) is electrically coupled to electrical ground. During operation, the inverter 56 receives an output voltage at the input terminal 134 from the inverter 54 and outputs an inverted amplified output voltage at the output terminal 136.

The inverter 58 includes a P-FET transistor 140, a FET transistor 142, an input terminal 144, and an output terminal 146. The P-FET transistor 140 includes a gate terminal (G13), a source terminal (S13), and a drain terminal (D13). The FET transistor 142 includes a gate terminal (G14), a source terminal (S14), and a drain terminal (D14). The P-FET transistor 140 is electrically coupled to the FET transistor 142. In particular, the gate terminals (G13), (G14) are electrically coupled together at the input terminal 144. The source terminal (S13) is electrically coupled to the primary output node 36. The drain terminal (D13) is electrically coupled to the source terminal (S14) at the output terminal 146. The output terminal 146 is electrically coupled to an input terminal 154. The terminal (D14) is electrically coupled to electrical ground. During operation, the inverter 58 receives an output voltage at the input terminal 144 from the inverter 56 and outputs an inverted amplified output voltage at the output terminal 146.

The inverter 60 includes a P-FET transistor 150, a FET transistor 152, an input terminal 154, and an output terminal 156. The P-FET transistor 150 includes a gate terminal (G15), a source terminal (S15), and a drain terminal (D15). The FET transistor 152 includes a gate terminal (G16), a source terminal (S16), and a drain terminal (D16). The P-FET transistor 150 is electrically coupled to the FET transistor 152. In particular, the gate terminals (G15), (G16) are electrically coupled together at the input terminal 154. The source terminal (S15) is electrically coupled to the primary output node 36. The drain terminal (D15) is electrically coupled to the source terminal (S16) at the output terminal 156. The output terminal 156 is electrically coupled to a gate terminal (G2) of the P-FET transistor 62. The terminal (D16) is electrically coupled to electrical ground. During operation, the inverter 60 receives an output voltage at the input terminal 154 from the inverter 58 and outputs an inverted amplified output voltage at the output terminal 156.

It should be noted that in an alternative embodiment, the linear voltage regulator 14 could be constructed by removing inverters 52, 54, 56, 58, 60 where inverter 82 would be directly electrically coupled to the P-FET transistor 62. Further, in other alternative embodiments, the number of inverters in the chain of inverters to amplify the voltage from the comparator circuit 50 can be greater than or less than the number of inverters shown in the chain of inverters of FIG. 1.

Referring to FIG. 1, the P-FET transistor 62 is provided to remove voltage deviations at the primary output node 36. In particular, the P-FET transistor 62 is provided to remove frequency components of the output voltage in a second frequency range. The P-FET transistor 62 includes a gate terminal (G2), a source terminal (S2), and a drain terminal (D2). The gate terminal (G2) is electrically coupled to the output terminal 156 of the inverter 60. The source terminal (S2) is electrically coupled to the voltage source 12. The drain terminal (D2) is electrically coupled to the primary node 36. The resistor 18 is electrically between the primary output node 36 and electrical ground. The resistor 18 corresponds to a load receiving the output voltage from the linear voltage regulator 14. During operation, when the P-FET transistor 62 receives a high logic voltage from the inverter 60 at the gate terminal (G2), the P-FET transistor 62 decreases current flowing therethrough to reduce the output voltage on the primary output node 36 in response to the high logic voltage. Alternately, when the P-FET transistor 62 receives a low logic voltage from the inverter 60 at the gate terminal (G2), the P-FET transistor 62 increases current flowing therethrough to increase the output voltage on the primary output node 36 in response to the low logic voltage.

Figure 4:
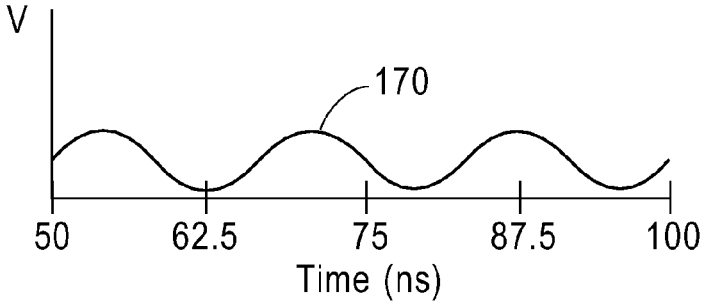
FIG. 4 is a schematic of a voltage signal output by a voltage source in the electrical system of FIG. 1.
Figure 5:
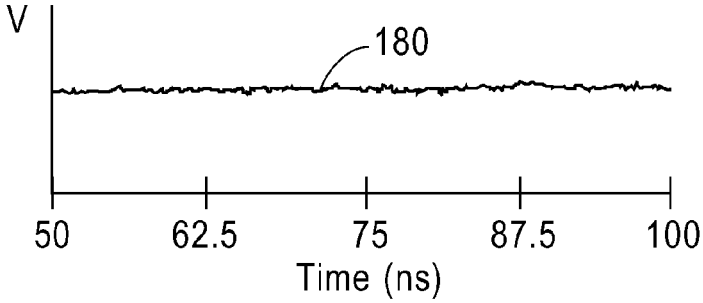
FIG. 5 is a schematic of a voltage signal output on a primary output node of the linear voltage regulator of FIG. 1.
Figure 6:
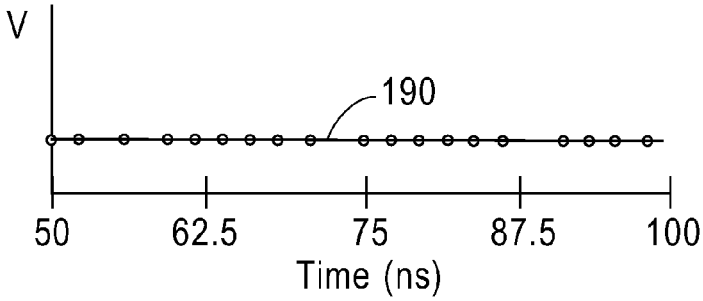
FIG. 6 is a schematic of a voltage signal output on a node in the comparator circuit of FIG. 2.
Figure 7:
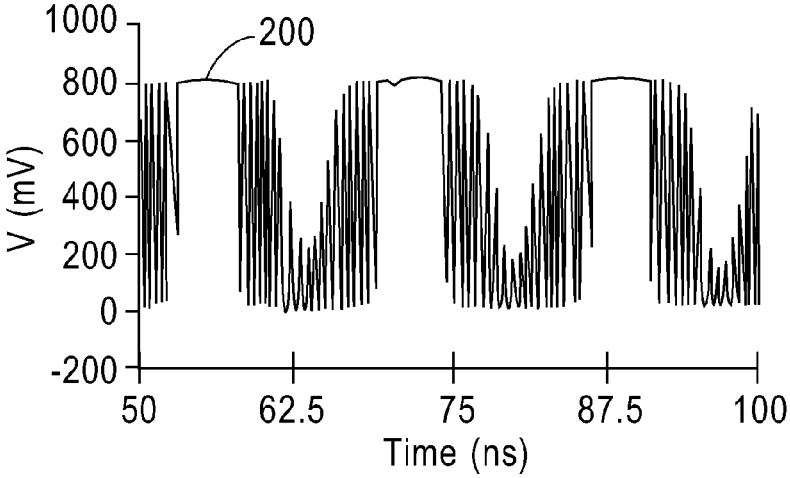
FIG. 7 is a schematic of a voltage signal output on a PFET transistor utilized in the linear voltage regulator of FIG. 1.

Referring to FIGS. 4-7, a brief explanation of exemplary schematics of signals generated by the linear voltage regulator 14 will now be provided. Referring to FIG. 4, a voltage curve 170 corresponds to an exemplary output voltage generated by the voltage source 12. As shown, the voltage curve 170 has oscillatory shape over time. Referring to FIG. 5, a voltage curve 180 corresponds to an output voltage generated by the linear voltage regulator 14 at the primary output node 36. As shown, the voltage curve 180 is relatively constant over time as desired. Referring to FIG. 6, a voltage curve 190 corresponds to an output voltage at the output terminal 96 of the comparator 50. Referring to FIG. 7, a voltage curve 200 corresponds to a voltage received at the gate terminal (G2) of the P-FET transistor 62 for controlling operation of the P-FET transistor 62.

Figure 8:
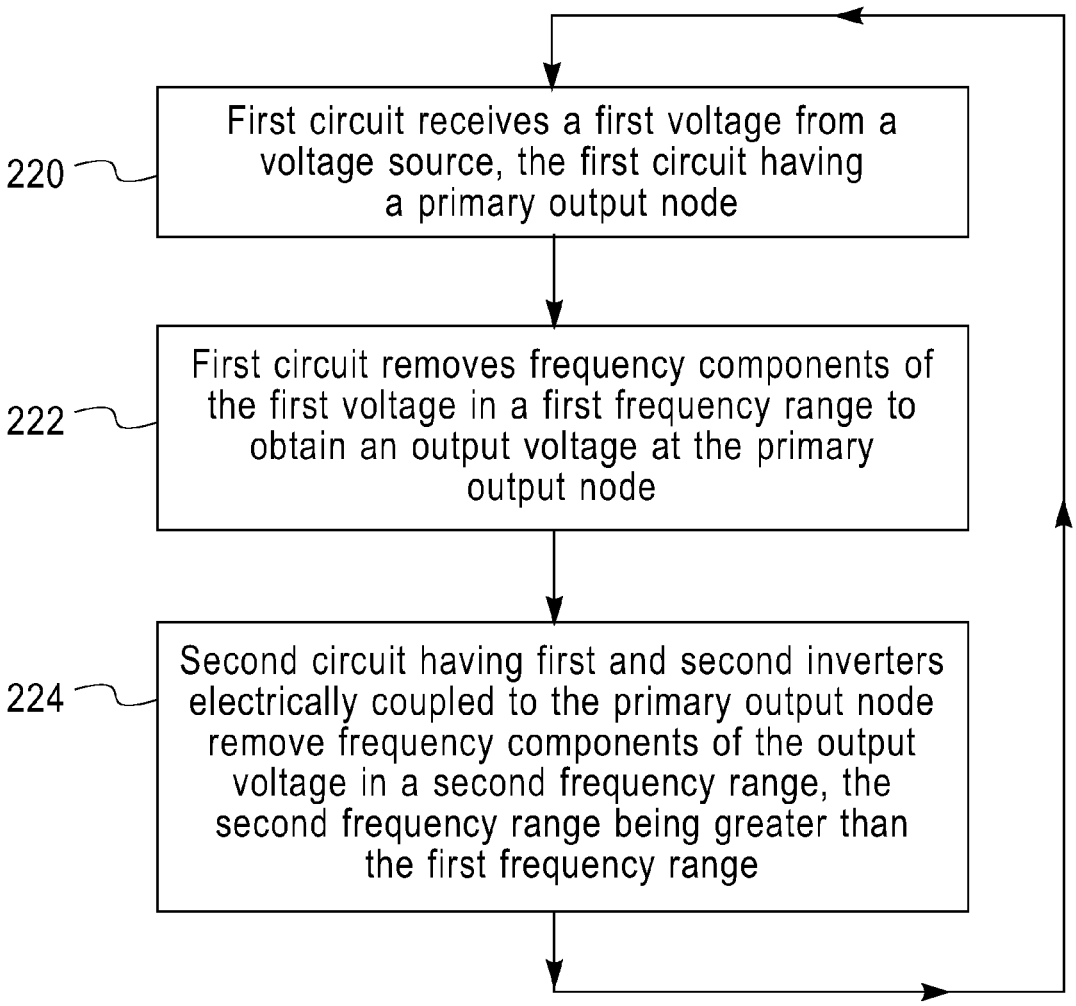
FIGS. 8-9 are flowcharts of a method for regulating a voltage using the linear voltage regulator of FIG. 1 in accordance with another exemplary embodiment.
Figure 9:
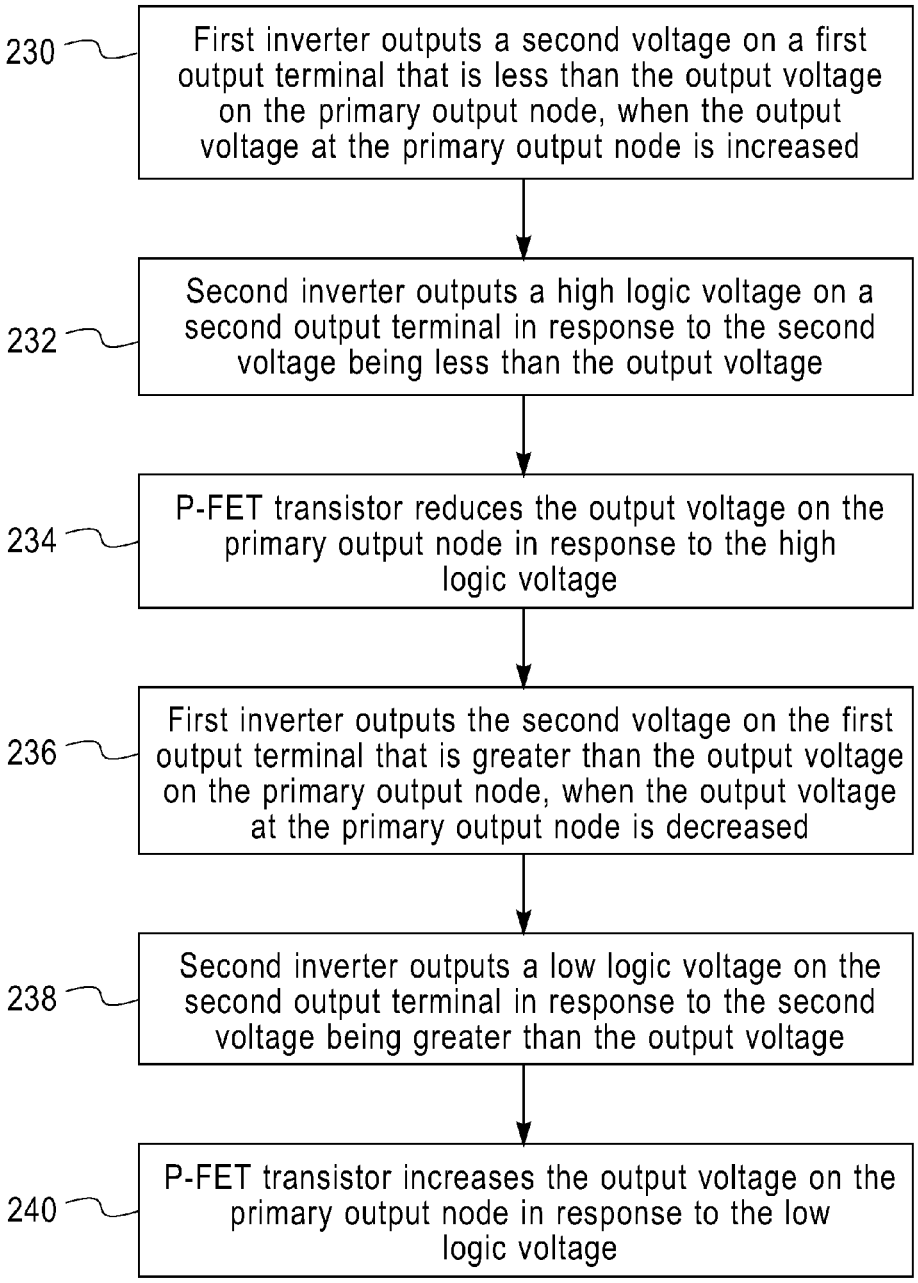

Referring to FIGS. 8-9, a flowchart of a method for regulating a voltage utilizing the linear voltage regulator 14 will now be described.

At step 220, the circuit 20 of the linear voltage regulator 14 receives a first voltage from the voltage source 12. The circuit 20 has the primary output node 36.

At step 222, the circuit 20 removes frequency components of the first voltage in a first frequency range to obtain an output voltage at the primary output node 36.

At step 224, the circuit 22 of the linear voltage regulator 14 has inverters 80, 82 electrically coupled either directly or indirectly to the primary output node 36 to remove frequency components of the output voltage in a second frequency range. The second frequency range is greater than the first frequency range. The step 224 is implemented utilizing steps 230-240.

At step 230, the inverter 80 outputs a second voltage on the output terminal 96 that is less than the output voltage on the primary output node 36, when the output voltage at the primary output node 36 is increased.

At step 232, the inverter 82 outputs a high logic voltage on the output terminal 106 in response to the second voltage being less than the output voltage.

At step 234, the P-FET transistor 62 reduces the output voltage on the primary output node 36 in response to the high logic voltage.

At step 236, the inverter 80 outputs the second voltage on the output terminal 96 that is greater than the output voltage on the primary output node 36, when the output voltage at the primary output node 36 is decreased.

At step 238, the inverter 82 outputs a low logic voltage on the output terminal 106 in response to the second voltage being greater than the output voltage.

At step 240, the P-FET transistor 62 increases the output voltage on the primary output node 36 in response to the low logic voltage. After step 240, the method returns to step 220.

The linear voltage regulator provides a substantial advantage over other regulators. In particular, the linear voltage regulator provides a technical effect of removing high-frequency components of a voltage utilizing a plurality of inverters.

While the invention is described with reference to an exemplary embodiment, it will be understood by those skilled in the art that various changes may be made and equivalent elements may be substituted for elements thereof without departing from the scope of the invention. In addition, many modifications may be made to the teachings of the invention to adapt to a particular situation without departing from the scope thereof. Therefore, it is intended that the invention not be limited the embodiment disclosed for carrying out this invention, but that the invention includes all embodiments falling with the scope of the intended claims. Moreover, the use of the terms first, second, etc. does not denote any order of importance, but rather the terms first, second, etc. are used to distinguish one element from another.

What is claimed is:

1. A linear voltage regulator comprising:

a first circuit configured to receive a first voltage from a voltage source and to remove frequency components of the first voltage in a first frequency range to obtain an output voltage at a primary output node; and a second circuit having first and second inverters electrically coupled to the primary output node of the first circuit, the second circuit configured to receive the output voltage and to remove frequency components of the output voltage in a second frequency range, the second frequency range being greater than the first frequency range;

wherein the first inverter has a first input terminal and a first output terminal, the first input terminal being electrically coupled to the first output terminal, the first input terminal being further electrically coupled to a capacitor which is further coupled to electrical ground, the first inverter being further electrically coupled to the primary output node such that a second voltage on the first output terminal is less than the output voltage at the primary output node; and the second inverter having a second input terminal and a second output terminal, the second input terminal being electrically coupled to the first output terminal of the first inverter, the second inverter being further electrically coupled to the primary output node; and the second circuit further comprises a P-FET transistor having a gate terminal, a drain terminal and a source terminal, the source terminal being electrically coupled to a voltage source, the drain terminal being electrically coupled to the primary output node, the gate terminal electrically communicating either directly or indirectly with the second output terminal of the second inverter, such that when the output voltage at the primary output node is increased, the second voltage on the first output terminal of the first inverter is less than the output voltage on the primary output node which induces the second inverter to output a high logic voltage on the second output terminal, and the P-FET transistor reduces the output voltage on the primary output node in response to the high logic voltage.

2. The linear voltage regulator of claim 1, wherein when the output voltage at the primary output node is decreased, the second voltage on the first output terminal of the first inverter is greater than the output voltage on the primary output node which induces the second inverter to output a low logic voltage on the second output terminal, and the P-FET transistor increases the output voltage on the primary output node in response to the low logic voltage.

3. The linear voltage regulator of claim 1, further comprising at least third and fourth inverters electrically coupled in series between the second output terminal of the second inverter and the gate terminal of the P-FET transistor.

4. The linear voltage regulator of claim 1, wherein the first frequency range is 0 to 10 Megahertz.

5. The linear voltage regulator of claim 1, wherein the second frequency range is 10 Megahertz to 6 Gigahertz.

* * * * *